US007109147B2

(12) United States Patent
Foster et al.

(10) Patent No.: US 7,109,147 B2
(45) Date of Patent: Sep. 19, 2006

(54) SLIPPING LAYER CONTAINING A BRANCHED OLEFIN FOR A DYE-DONOR ELEMENT USED IN THERMAL DYE TRANSFER

(75) Inventors: David G. Foster, West Henrietta, NY (US); Maurice L. Gray, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 306 days.

(21) Appl. No.: 10/614,600

(22) Filed: Jul. 7, 2003

(65) Prior Publication Data

US 2005/0009700 A1 Jan. 13, 2005

(51) Int. Cl.
*B41M 5/035* (2006.01)
*B41M 5/38* (2006.01)

(52) U.S. Cl. ..... 503/227; 428/32.67

(58) Field of Classification Search ..... 428/32.64, 428/32.65, 32.66, 32.67, 32.68; 503/227
See application file for complete search history.

(56) References Cited

U.S. PATENT DOCUMENTS

| | | | | |
|---|---|---|---|---|
| 4,686,549 | A | 8/1987 | Williams et al. | |
| 4,866,026 | A | 9/1989 | Henzel et al. | 503/227 |
| 4,898,751 | A | 2/1990 | Dwivedy | |
| 4,910,087 | A | 3/1990 | Torii et al. | |
| 4,916,112 | A | 4/1990 | Henzel et al. | 503/227 |
| 5,627,130 | A | 5/1997 | Bailey et al. | |
| 5,939,207 | A | 8/1999 | Fensore et al. | |
| 6,103,042 | A | 8/2000 | Hatada et al. | 503/227 |
| 2002/0044192 | A1 | 4/2002 | Hirano | |

FOREIGN PATENT DOCUMENTS

| | | | |
|---|---|---|---|
| EP | 1 205 313 A1 | 5/2002 | |
| WO | WO 03/037644 | 5/2003 | 503/227 |

*Primary Examiner*—Bruce H. Hess
(74) *Attorney, Agent, or Firm*—Chris P. Konkol; Kathleen Neuner Manne

(57) ABSTRACT

A dye-donor element for thermal dye transfer comprising a support having on one side thereof a dye layer and on the other side a slipping layer comprising at least two waxes, a branched alpha-olefin polymer and another wax.

20 Claims, No Drawings

SLIPPING LAYER CONTAINING A BRANCHED OLEFIN FOR A DYE-DONOR ELEMENT USED IN THERMAL DYE TRANSFER

CROSS REFERENCE TO RELATED APPLICATION

Reference is made to commonly assigned, co-pending U.S. patent application Ser. No. 10/614,378 by Foster et al., filed Jul. 7, 2003, entitled "Slipping Layer Containing Wax Mixture For Dye-Donor Element used in Thermal Dye Transfer", now abandoned, and U.S. patent application Ser. No. 10/614,379 by Foster et al., filed Jul. 7, 2003, entitled "Slipping Layer For Dye-Donor Element used in Thermal Dye Transfer," now U.S. Pat. No. 7,078,366.

FIELD OF THE INVENTION

This invention relates to dye donor elements used in thermal dye transfer, and more particularly to the use of a blend of a branched olefinic polymer with at least one other wax in the slipping layer on the back side thereof to improve the performance of the donor element before and during the printing operation.

BACKGROUND OF THE INVENTION

In recent years, thermal transfer systems have been developed to obtain prints from pictures which have been generated electronically from a color camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

U.S. Pat. No. 4,910,087 discloses a heat-resistant slipping layer on the back surface of a thermal dye-donor element comprising a polyurethane or polyurea resin modified with polysiloxane bonds. There are a number of problems with this slipping layer including sticking between the dye layer and slipping layer when the donor is rolled up and head debris built-up upon processing. It is an object of this invention to eliminate or reduce such problems.

U.S. Pat. No. 5,627,130 discloses a heat-resistant slipping layer on the back surface of a thermal dye-donor element comprising a siloxane copolymer for a dye-donor slipping layer. U.S. Pat. No. 4,916,112 discloses a slipping layer comprising a nonhomogenous layer of a particulate ester wax.

U.S. Pat. No. 4,898,751 to Dwivedy discloses methods and compositions for inhibiting and/or preventing the adhesion of materials such as coal or coke to container walls due to weather conditions. The composition comprises a polymeric poly-α-olefin wax and a resin in a hydrocarbon solvent.

U.S. Pat. No. 5,939,207 to Fensore et al. discloses a dye-donor element including a release layer between a pigmented layer and a substrate, the release layer composed of an ethylene vinylacetate copolymer, an α-olefin maleic anhydride copolymer and a wax. EP 1205 313 A1 to Eike discloses a dye-donor element with a coloring layer on a substrate wherein the coloring layer is formed of a mixture of a copolymerization product obtainable by polymerizing an α-olefin/a maleic acid anhydride copolymer with a maleic acid anhydride monoester and an ethylene/vinyl acetate copolymer. Finally, U.S. Patent Publ. 2002/0044192 to Hirano discloses a similar composition used as an adhesive layer disclosed between a coloring layer and a substrate of a dye-donor element, also referred to as a thermal transfer sheet.

A continuing problem with dye-donor elements in the prior art, especially when enabling faster printing, is sticking or friction between the dye-donor element and the thermal head, undesirable folds, and retransfer.

In particular, a problem arises with the use of dye-donor elements for fast thermal dye-transfer printing because a thin support is required in order to provide effective heat transfer. For example, when a thin polyester film is employed, it can soften when heated during the printing operation and then sticks to the thermal printing head, preventing donor transport. A slipping layer is typically provided to facilitate passage of the dye-donor under the thermal printing head. A deficiency in the performance of that layer causes intermittent rather than continuous transport across the thermal head. The dye transferred thus does not appear as a uniform area, but rather as a series of alternating light and dark bands (so-called "chatter marks").

A desirable performance characteristic for a slipping layer is a smooth transfer across a wide range of printing conditions. Variable print forces along either the length or width of a print could cause image defects. Differences in print forces are specially magnified in regions of abrupt temperature change. At the transition from Dmax (maximum print density) to Dmin (minimum print density), the force may spike upward from Dmax to a peak force and then return to Dmin. This differential is referred to as "pops" since an audible popping noise can be heard in extreme cases during printing.

SUMMARY OF INVENTION

This invention relates to a dye-donor element for thermal dye transfer comprising a support having on one side thereof a dye layer and on the other side a slipping layer comprising at least two waxes, a branched alpha-olefin polymer and another wax.

In particular, the invention relates to a new slipping layer formulation for resistive head thermal media which incorporates a synergistic combination of lubricants from a friction perspective and in terms of headwear buildup.

DETAILED DESCRIPTION OF THE INVENTION

As indicated above, the invention is directed to a dye-donor element for thermal dye transfer comprising a support having on one side thereof a dye layer and on the other side a slipping layer comprising a wax mixture, the improvement wherein said wax mixture comprises at least two waxes, a branched alpha-olefin polymer and another wax. In one embodiment, the ratio if the former wax to the latter wax is 5:1 to 1:10, preferably 2:1 to 1:5.

In one embodiment, the branched hydrocarbon typically has a number average molecular weight (as measured by vapor pressure osmometry) of at least about 300, preferably at least about 400, and more preferably at least about 500, and typically has a number average molecular weight of no more than about 10,000, preferably no more than about 5,000, and more preferably no more than about 3,000, although the molecular weight can be outside of these ranges. The branched hydrocarbon typically has a melting point (for crystalline materials) or a softening point (for amorphous or semicrystalline materials) of at least about 30° C., preferably at least about 35° C., and more preferably at least about 50° C., and typically has a melting point or softening point of no more than about 120° C., preferably no more than about 110° C., and more preferably no more than about 100° C., although the melting point can be outside of these ranges. The degree of branching (or average number of branches per molecule) in the branched hydrocarbon typically is at least about 4, and preferably at least about 5, and typically is no more than about 15, and preferably no more than bout 10, although the degree of branching can be outside of these ranges. The hydrocarbon can be saturated or unsaturated, and can include cyclic moieties. In addition, oxidized hydrocarbons, such as polyethylene-based oxidized materials and microcrystalline-based oxidized materials can be used, as can unsaturated and branched hydrocarbon-like molecules using as a core cyclic compounds or dendrimer or arborols. Also suitable are homopolymers and copolymers prepared from monomers of the formula $RCH{=}CH_2$ wherein R is an alkyl group, typically with from about 1 to about 18 carbon atoms, and preferably with from about 3 to about 12 carbon atoms, although the number of carbon atoms can be outside of these ranges. The polymerized alpha-olefin used in this invention is also known as an olefin derived hydrocarbon polymer or catalytically polymerized alpha-olefin. The polymerized alpha-olefins are prepared from alpha-olefins having the formula:

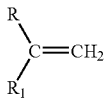

where R is $C_6$ to $C_{50}$ alkyl, preferably $C_{18}$–$C_{40}$ alkyl and $R^1$ is hydrogen or $C_6$ to $C_{50}$ alkyl, preferably hydrogen. The polymerization process is described in U.S. Pat. No. 4,060,569 which is incorporated herein by reference. The alpha-olefin is polymerized in the presence of a free radical catalyst. The nature of the free radical catalyst is not critical. Typical free radical catalysts include peroxides and hydroperoxides. The molar ratio of free radical catalyst to alpha-olefin is from about 0.005 to 0.35. A convenient measure of the effective presence of a free radical catalyst is its half-life which is employed as a measure of reaction time based on the number of half-lives. In general, reaction times of from about 1 to 20 half-lives are suitable. The polymerization is carried out at low pressures. The only pressure needed is that necessary to prevent vaporization of the free radical or alpha-olefin. Such pressures are typically less than about 500 psig. The polymerization temperature is typically set such that the free radical catalyst would have a half-life between 0.5 and 3 hours. This in turn is a function of the temperature at which the free radical catalyst decomposes. For peroxides and hydroperoxides, such temperatures are generally in a range from about 40° C. to 250° C. The reaction temperature employed will depend on the decomposition temperature of the particular peroxide or hydroperoxide used as catalyst.

The polymerized alpha-olefins are characterized in that they have higher viscosities and greater hardness but lower melting and congealing points than the alpha-olefins from which they are derived. This is in contrast to typical hydrocarbon polymers which have higher viscosities and greater hardness but also higher melting and congealing points than the hydrocarbon monomers from which they are derived. Because of their relatively low molecular weights, the polymerized alpha-olefins are also known as polymeric waxes or polymerized alpha-olefin waxes.

The polymerized alpha-olefins are commercially available. Suitable polymerized alpha-olefins are available from the Bareco Division of Petrolite Corporation under the registered trademark VYBAR, which is available in solid (e.g. VYBAR 103, VYBAR 260) or liquid (e.g. VYBAR 825) form. (VYBAR is a trademark of Petrolite Corporation.) The use of the polymerized alpha-olefin in solid rather than liquid form is preferred.

VYBAR® is a polymerized α-olefin prepared by polymerizing α-olefins under free radical conditions at low pressures. The polymers are unique in that although α-olefin polymers generally have higher molecular weight, greater viscosity and greater hardness than the starting monomer, VYBAR polymers generally have lower melting points and congealing points than the starting monomer. The monomers employed are primarily alpha-olefins of the formula $RCH{=}CH_2$ where R is an alkyl group having about 4 to 50 carbon atoms or is a mixture of alpha-olefins, vinylidene compounds, internal olefins and saturated hydrocarbons. Because alpha-olefins are primarily employed, this term is often used to indicate both alpha-olefins and mixtures of various combinations of alpha-olefins, vinylidenes, internal olefins and saturates.

Examples of suitable branched hydrocarbons include VYBAR® 253 available from Baker Petrolite Corp., an alpha-olefin with a number average molecular weight of about 520, a softening point of about 67° C. (measured by ASTM method D36) and a degree of branching of from about 5 to about 10. This material is a polymer based on an ethylene structure having pendant hydrocarbon side chains, also referred to as a poly-α-olefin or a poly-1-alkene. Also suitable are VYBAR® 103, with a number average molecular weight of 2,800, VYBAR® 260, with a number average molecular weight of 2,600, and the VYBAR® X-series polymers, such as X-6044, X-6059, X-6028, and the like. Also suitable are oxidized hydrocarbons such as those available from Petrolite as polyethylene-based oxidized materials and microcrystalline-based oxidized materials, such as the CARDIS® and PETRONAUBA® materials.

A particularly preferred branched polyolefin is X-6031® (a.k.a. Vybar® 103), CAS #68527-08-2, described as alkenes, macromonomers with C>10 (greater than 10 carbon atoms) alpha-polymerized with a softening point of 74° C. (165.2° F.). Additional information on this material can be found at the following website:

Vybar 103: http://www.bakerhughes.com/bakerpetrolite/polymers/vybar/index.htm

In general, the second wax is any suitable wax which will form a hydrophobic coating and can be blended with the branched olefin. Thus, animal, vegetable, mineral and synthetic waxes may be employed, as may be mixtures thereof.

Generally speaking, a wax is a substance which is a solid at ambient temperature and which has a low viscosity at just above its melting point. Typically, a wax is a substance having the following properties: (1) crystalline to microcrystalline structure, (2) capacity to acquire gloss when rubbed (as distinct from greases), (3) capacity to produce pastes or gels with suitable solvents or when mixed with other waxes, (4) low viscosity at just above the melting point. See *Grant & Hackh's Chemical Dictionary* ($5^{th}$ Edition), page 628, hereby incorporated by reference. Waxes differ from fats in that facts are the esters of the trihydric, lower alcohols.

The following are illustrative types of waxes which may be employed:

| Source | Examples | Compositions |
|---|---|---|
| Mineral Waxes | Paraffin | 26–30 Carbon atom molecules of aliphatic hydrocarbons. |
| | Microcrystalline | 41–50 Carbon atom molecules of branched-chain hydrocarbons. |
| | Oxidized microcrystalline | Hydrocarbons, esters, fatty acids. |
| | Montan | Wax acids, alcohols, esters, ketones. |
| | Hoechst | Acids, esters (obtained by oxidizing montan wax); |
| | Ozokerite | High mol. wt. aliphatic and alkenyl hydrocarbons. |
| Vegetable Waxes | Carnauba | Complex alcohols, hydrocarbons, resins. |
| | Esparto | Mainly hydrocarbons. |
| | Flax | Fatty acid esters, hydrocarbons. |
| | Sugarcane wax | Hydrocarbons, aldehydes, esters. alcohols. |
| | Candelilla | Hydrocarbons, acids, esters, alcohols, resins. |
| Animal Waxes | Beeswax | Hydrocarbons, acids, esters, alcohols, lactones. |
| Synthetic Waxes | Fischer-Tropsch, Polyolefins | Saturated and unsaturated hydrocarbons, oxygen-containing hydrocarbons. |

One preferred wax is the fully saturated homopolymers of polyethylene, or copolymers of various alkene monomers, forming polymers with a molecular weight at or below 3,000, a melting point below 130° C., and low melt viscosities. Applicable waxes could include "POLYWAX" available from Petrolite Corp. (St. Louis, Mo.)

POLYWAX® is a linear polyethylene wax. A particularly preferred wax is X-2071® (a.k.a. Polywax® 400), CAS # 9002-88-4, described as polyethylene homopolymer with weight average molecular weight of about 400 and a melting point of 79.5° C. (175.1° F.). Additional information on this material can be found at the following website: Polywax 400:

http/www.bakerhughes.com/bakerpetrolite/polymers/ethylene_homopolymers.htm

The wax mixture defined above can be employed in the invention herein at any concentration useful for the intended purpose. In general, good results have been obtained at a concentration of about 0.02 to about 0.12 g/m$^2$, preferably about 0.03 to about 0.09 g/m$^2$, with or without a binder.

Any binder may also be used in the slipping layer of the invention provided it will be useful for the intended effect. In a preferred embodiment, polymeric thermoplastic binders are employed. Examples of such materials include, for example, Poly(styrene-coacrylonitrile) (70/30 wt. ratio); poly(vinyl alcohol-co-butyral) (available commercially as Butvar 76.RTM. by Monsanto Corp.); poly(vinyl alcohol-co-acetal); poly(vinyl alcohol-co-benzal); polystyrene; poly (vinyl acetate); cellulose acetate butyrate; cellulose acetate propionate; cellulose acetate; ethyl cellulose; cellulose triacetate; poly(methylmethacrylate); copolymers of methyl methacrylate; etc. In another preferred embodiment of the invention, the thermoplastic binder is cellulose acetate propionate or polyvinyl acetal.

The amount of the optional binder employed in the slipping layer of the invention is not critical. In general, the binder may be employed in an amount of from about 0.1 to about 2 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumickaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumicacryl Blue 6G® (Sumitomo Chemical Co., Ltd.), and Aizen Malachite Greene® (Hodogaya Chemical Co., Ltd.);

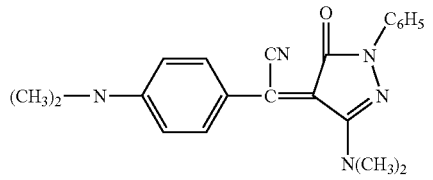

(magenta)

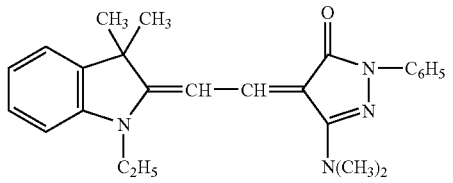

(yellow)

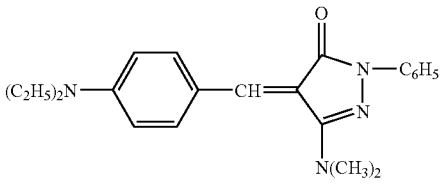

(yellow)

-continued

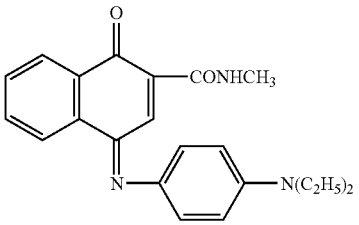

(cyan)

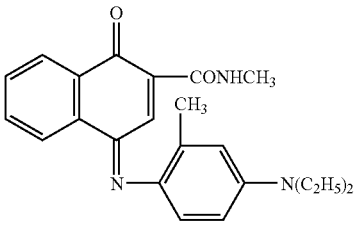

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly (tetrafluoroethylene-co-hexafluoropropylene); polyethers such as polyoxymethylene; polyacetals; polyolefins such as polystyrene, polyethylene, polypropylene or methylpentane polymers; and polyimides such as polyimide amides and polyetherimides. The support generally has a thickness of from about 2 to about 30 micrometers. It may also be coated with a subbing layer, if desired, such as those materials described in U.S. Pat. No. 4,695,288 or U.S. Pat. No. 4,737,486.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

The support for the image receiving layer may be transparent or reflective, and may comprise a polymeric, a synthetic paper, or a cellulosic paper support, or laminates thereof. Examples of transparent supports include films of poly(ether sulfones), polyimides, cellulose esters such as cellulose acetate, poly(vinyl alcohol-co-acetals), and poly (ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. Supports for the dye receiving layer are, for example, disclosed in commonly assigned U.S. Pat. Nos. 5,244,861, EP0671281, and U.S. Pat. No. 5,928,990, which are hereby incorporated by reference in their entirety.

The composition, for use in an image-receiving layer, may also contain a release agent, such as a silicone or fluorine based compound, as is conventional in the art. Resistance to sticking during thermal printing may be enhanced by the addition of such release agents to the dye-receiving layer or to an overcoat layer. Various releasing agents are disclosed, for example, in U.S. Pat. No. 4,820,687 and U.S. Pat. No. 4,695,286, the disclosures of which are hereby incorporated by reference in their entirety.

As noted above, the dye donor elements of the invention are used to form a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following examples are provided to illustrate the invention.

EXAMPLE 1

This example shows the superiority of the slip layer according to the present invention in terms of preventing sticking and providing smooth transfer of the dye-donor past the print head. A defect or deficiency in the performance of that layer causes intermittent rather than continuous transport across the thermal head. The dye transferred thus does not appear as a uniform area, but rather as a series of alternating light and dark bands (so-called "chatter marks").

Smooth transfer across a wide range of printing conditions is another desirable performance characteristic for a slipping layer. Variable print forces along either the length or width of a print could cause image defects. Differences in print forces are specially magnified in regions of abrupt temperature change. At the transition from Dmax (maximum print density) to Dmin (minimum print density), the force may spike upward from Dmax to a peak force and then return to Dmin. This differential is referred to as "pops" since an audible popping noise can be heard in extreme cases during printing.

A dye donor element was prepared by coating the following layers in the order recited on 4.5 micron poly (ethylene terephthalate) support:

(1) a subbing layer of a titanium alkoxide (DuPont Tyzor TBT®) (0.12 g/m$^2$) from n-propyl acetate and n-butyl alcohol solvent mixture, and (2) a dye layer containing repeating alternating areas of the cyan dye illustrated above (0.37 g/m$^2$), the magenta dye illustrated above (0.28 g/m$^2$) and the yellow dye illustrated above (0.15 g/m$^2$) in a cellulose acetate propionate binder (0.27 g/m$^2$) coated from toluene, methanol and cyclopentanone solvent mixture.

A dye donor slipping layer side was prepared by coating the following layers in the order recited on 4.5 micron poly(ethylene terephthalate) support:

(1) a subbing layer of a titanium alkoxide (DuPont Tyzor TBT®) (0.12 g/m$^2$) from n-propyl acetate and n-butyl alcohol solvent mixture, and (2) a slipping layer of polymers listed below in a polyvinyl acetal binder (0.4 g/m$^2$) coated out of an appropriate solvent as illustrated in Table 1, being either (A) diethyl ketone and methanol or (B) toluene, methanol and cyclopentanone.

The slipping-layer polymers used in the test were as follows:

Invention Polymers (IP):

IP1: Polywax 400®, ethene homopolymer, from Baker-Petrolite Polymers (Sugar Land, Tex.).

IP2: Vybar 103®, polyalphaolefin, from Baker-Petrolite Polymers (Sugar Land, Tex.).

The test donor samples with copolymer slipping layers applied as described were subjected to conventional testing for the force needed to transport the donor/receiver combination past a thermal print head as follows:

The dye side of the above donor set element strip was placed in contact with the dye-receiving layer of the same area. This assembly was clamped to a stepper motor driving a 60 mm diameter rubber roller. Next, a TDK Model L-231 thermal head, thermostatted at 28° C. was pressed against the slipping layer side of the assembly with a force of 24.75 Newton (5.5 lbs) pushing it against the rubber roller.

The imaging electronics were activated causing the donor/receiver assemblage to be drawn between the print head and roller. At the same time the resistive elements in the thermal print head were pulsed for 128 microsec/pulse at 134 microsecond intervals during the 4.575 millisec/dot printing time. A stepped density image was generated incrementally increasing the number of pulses/dot from 0 to 32 (Dmin to Dmax). The voltage supplied to the print head was approximately 13 volts, resulting in a maximum total energy of approximately 1.45 mJ/dot.

The test pattern consisted of a series of bars, first a series of wider bars (and then a series of narrower bars. In particular, a first wide bar at high density (to warm up the printhead) was followed by a second wide bar at low density Dmax, followed by a third wide bar at high density. This was followed by a wide bar at Dim and then a series of thinner alternating high density and zero density bars.

The Dmid1, Dmid2 and Dmid3 parameters were taken from friction readings of the second first cyan bar, respectively near the beginning, middle, and end of the bar. The Dmax1 and Dmax2 were taken from the third bar, near the begging and end thereof. The Dmin reading was taken from the area of no printing after the third cyan bar. The "Pops" reading were taken from eight successive areas of printing/not printing which simulates D-max, then D-min printing. According to the test, low friction numbers are desired, and also similar friction numbers between the hot and cold areas.

As each area test pattern of given density was being generated, the torque required to draw the assemblage through the print nip was measured with a Himmelstein Corp. Model 3-308TL (16-1) Torquementer (1.09 meter-Newton range) and Model 6,201 Conditioning Module. Print forces below 10 newton are generally acceptable. Data were taken at 0 pulses/dot (Dmin), 8 pulses/dot (Dmid), and at 32 pulses/dot (Dmax).

Table 1 below shows the friction gauge testing results for various polymer combinations:

TABLE 1

| | Laydown g/m$^2$ | | | | | | | | |
|---|---|---|---|---|---|---|---|---|---|
| DESCRIPTION | IP2 | IP1 | Dmin | Dmid2 | Dmid1 | Dmid3 | Dmax1 | Dmax2 | POP |
| IP1 | | 0.06 | 2.08 | 2.81 | 3.19 | 2.21 | 5.08 | 4.06 | 18.63 |
| IP2 | 0.06 | | 3.48 | 2.74 | 2.74 | 2.62 | 2 | 1.91 | 2.11 |
| IP2 + IP1 | 0.03 | 0.03 | 2.31 | 2.79 | 2.79 | 2.64 | 2.78 | 2.53 | 2.08 |

The above results indicate that the slipping layer according to the invention gave superior performance as compared to the control materials. The data below illustrate the synergistic effect of the two polymers, IP1 and IP2. In the data of Table 1, the lower the numerical value, the better the performance of the slipping layer, the units being in pounds.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on side thereof a dye layer and on the other side a slipping layer, the improvement wherein said slipping layer comprises at least two waxes, a branched alpha-olefin polymer and at least one other wax.

2. The element of claim 1 wherein the other wax is selected from the group consisting of microcrystalline wax, carnauba wax, petronable wax, paraffin wax, candelilla wax and low molecular weight polyethylene.

3. The element of claim 1 wherein the other wax is a saturated hydrocarbon polymer.

4. The element of claim 1 wherein the other wax is a linear low molecular weight polyethylene.

5. The element of claim 1 wherein the branched alpha-olefin has a number average molecular weight of no more than about 10,000 and a melting point or softening point of no more than about 120° C.

6. The element of claim 5 wherein the branched alpha-olefin has a number average molecular weight of at least 300.

7. The element of claim 5 wherein the branched alpha-olefin has a number average molecular weight of 400 to 5000.

8. The element of claim 5 wherein the branched alpha-olefin has a number average molecular weight of 1000 to 3000.

9. The element of claim 5 wherein the branched alpha-olefin has a melting point or softening point of 35 to 110° C.

10. The element of claim 5 wherein the branched alpha-olefin has a melting point or softening point of 50 to 100° C.

11. The element of claim 5 wherein the branched alpha-olefin has a degree of branching of about 4 to about 15.

12. The element of claim 5 wherein the branched alpha-olefin has a degree of branching of about 5 to about 10.

13. The element of claim 5 wherein the branched alpha-olefin comprises a polymerized alpha-olefin prepared from alpha-olefins having the formula:

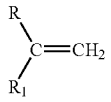

where R is $C_6$ to $C_{50}$ alkyl and $R^1$ is hydrogen or $C_6$ to $C_{50}$ alkyl, wherein the polymerized alpha-olefin has a number average molecular weight of 500 to 5000.

14. The element of claim 1 wherein the other wax is a synthetic wax that is primarily a saturated or unsaturated hydrocarbon.

15. The element of claim 1 wherein the other wax is selected from the group consisting of a mineral wax, a vegetable wax, an animal wax or a synthetic wax that is a saturated or unsaturated hydrocarbon polymer.

16. The element of claim 1 wherein the ratio if the first wax to the other wax is 5:1 to 1:10.

17. The element of claim 1 wherein the other wax is a saturated hydrocarbon polymer.

18. The element of claim 1 wherein the other wax is a linear low molecular weight polyethylene.

19. In a process of forming a dye transfer image comprising a dye transfer image comprising:

(a) imagewise-heating a dye-donor element comprising a support having on one side thereof a dye layer and on the other side a slipping layer comprising a lubricating material, and (b) transferring a dye image to a dye receiving element to form said dye transfer image, the improvement wherein said lubricating material comprises a comprises a branched alpha-olefin polymer and another wax.

20. In a thermal dye transfer assemblage comprising (a) a dye-donor element comprising a support having on one side thereof a dye layer and on the other side a slipping layer comprising lubricating material, and (b) a dye receiving element comprising a support having thereon a dye image-receiving layer, said dye-receiving element being in a superposed relationship with said dye-donor element so that said dye layer is in contact with said dye image-receiving layer, the improvement wherein said lubricating material comprises a branched alpha-olefin polymer and another wax.

* * * * *

UNITED STATES PATENT AND TRADEMARK OFFICE

CERTIFICATE OF CORRECTION

PATENT NO. : 7,109,147 B2
APPLICATION NO. : 10/614600
DATED : September 19, 2006
INVENTOR(S) : David G. Foster et al.

It is certified that error appears in the above-identified patent and that said Letters Patent is hereby corrected as shown below:

Column 12, line 47 Replace "said lubricating material comprises a comprises a" with --said lubricating material comprises a--

Signed and Sealed this

Third Day of April, 2007

JON W. DUDAS
*Director of the United States Patent and Trademark Office*